United States Patent [19]

Alexander

[11] Patent Number: 4,535,850

[45] Date of Patent: Aug. 20, 1985

[54] POWER-OPERATED FASTENER TOOL

[75] Inventor: Robert H. Alexander, Columbia, S.C.

[73] Assignee: Rockwell International Corporation, Pittsburgh, Pa.

[21] Appl. No.: 356,095

[22] Filed: Mar. 8, 1982

Related U.S. Application Data

[63] Continuation of Ser. No. 104,209, Jan. 6, 1971, abandoned.

[51] Int. Cl.[3] ..... B25B 23/14

[52] U.S. Cl. ..... 173/12; 173/163; 81/477

[58] Field of Search ..... 173/12, 163; 81/477, 81/469; 464/21, 57, 77

[56] References Cited

U.S. PATENT DOCUMENTS

| | | | |
|---|---|---|---|
| 976,232 | 11/1910 | Tyson | 464/57 |
| 1,535,639 | 4/1925 | Weber | 464/57 |
| 1,662,223 | 3/1928 | Werner et al. | 464/57 |
| 2,012,916 | 8/1935 | Pott | 81/477 |
| 2,035,554 | 3/1936 | Krejmas | 464/57 |
| 2,100,552 | 11/1937 | Ripsch et al. | 192/56 |
| 2,543,979 | 3/1951 | Maurer | 192/150 |
| 2,600,327 | 6/1952 | Ridge | 81/477 |
| 2,608,118 | 8/1952 | Disser | 81/477 |
| 2,662,434 | 12/1953 | Burkhardt | 81/477 |
| 2,764,272 | 9/1956 | Reynolds | 192/150 |
| 3,122,902 | 3/1964 | Blair et al. | 464/21 |
| 3,195,704 | 7/1965 | Linsker | 173/12 |
| 3,276,524 | 10/1966 | Falter | 173/163 |
| 3,477,521 | 11/1969 | Kiester et al. | 173/12 |
| 3,666,021 | 5/1972 | Whitehouse | 173/12 |
| 3,744,350 | 7/1973 | Raff | 81/477 |
| 3,970,151 | 7/1976 | Workman | 173/12 |

FOREIGN PATENT DOCUMENTS

| | | | |
|---|---|---|---|
| 13011 | of 1905 | United Kingdom | 81/477 |

*Primary Examiner*—James A. Leppink
*Assistant Examiner*—Mark J. DelSignore

[57] ABSTRACT

A power-operated tool including a motor, an output member to which a fastener engaging component is adapted to be secured, and a drive train between the motor and output member which includes an arrangement for absorbing kinetic energy from the motor to keep such energy from being applied to and overtightening a fastener engaged by the fastener engaging component.

17 Claims, 7 Drawing Figures

POWER-OPERATED FASTENER TOOL

This application is a continuation of application Ser. No. 104,209 filed Jan. 6, 1971, now abandoned.

The present invention relates to power-operated tools and, more specifically, to power-operated tools for tightening fasteners.

In a typical application, a tool of the type to which this invention relates will be employed to tighten a nut on a bolt to a selected torque to fasten two pieces of metal together, i.e., to form a joint between the two pieces of metal. Joints are typically classified as soft and hard joints and may range from very soft to very hard.

The hardness of a joint can be expressed in terms of the foot pounds of energy required to rotate a handtight fastener one revolution. A ten foot-pound per revolution joint would be a soft joint, a 300 foot-pound per revolution joint would be a hard one.

A typical soft joint is one where the parts being joined are bent or warped or formed of a resilient or deformable material and are therefore drawn together as the fastener is tightened. In this case the fastener engaging component may make three or more revolutions in tightening the fastener from handtight to the selected torque.

In contrast, a hard joint may involve two flat, relatively thick, ground plates so that there is virtually no drawing together of or elasticity in the plates as the fastener is tightened. In this case the fastener engaging component may revolve only a fraction of a revolution in tightening the fastener from handtight to the selected torque.

Many tools are equipped with a torque responsive control to shut off the motor of the tool or to disengage a clutch when the fastener is tightened to the selected torque. Tools equipped with this type of torque responsive control are disclosed in U.S. Pat. Nos. 2,100,552; 2,543,979; 2,600,327; 2,608,118; 2,764,272; and 3,195,704. In a torque control tool, a spring interposed in the drive train between the motor and the output shaft of the tool is wound until a selected preload force has been preset into it. This spring acts as a solid link until the fastener is tightened to the torque at which the spring is preset. The spring then begins to wind, and the motion of the spring produces a relative movement between drive train members connected through the spring which is utilized to shut off the motor or disengage the clutch of the tool.

However, tools of the type with which this invention is concerned are typically powered by an air motor having a rotor which rotates at high speed—20,000 rpm is not unusual. The rotor accordingly has a considerable amount of kinetic energy as it rotates at rated speed. A conventional torque responsive control is not capable of preventing this kinetic energy from being transmitted to the fastener when a hard joint is involved.

This is because the fastener reaches the desired torque in only a fraction of a revolution, and the motor is still running at substantially full speed when this torque is reached. Therefore, if the control is of the shut-off type, substantially all of the kinetic energy in the rotor is transmitted to the fastener even if the tool motor is shut off when the selected torque is reached. And, even in the case of the clutch disengaging type of control, the clutch can not be disengaged fast enough to keep the fastener from being further tightened after the torque control spring begins to wind.

To prevent overtightening, conventional tools are commonly set to shut off or disengage when the fastener reaches a torque somewhat lower than the selected torque. The energy thereafter transmitted from the motor to the fastener while the motor slows down or the clutch disengages is employed to tighten the fastener to the selected torque. However, as the kinetic energy transmitted to the fastener varies with the hardness of the joint, this differential must be changed each time the hardness of the joint changes by recalibrating the tool. This is of course generally impractical in circumstance where a single tool and joints of continually varying hardness are involved, since the tool would have to be recalibrated after each joint is completed.

Absent a satisfactory control, the industry has turned to other approaches for reducing the sensitivity of fastener tools to joint hardness. One of these is to lighten the rotor of the tool motor as much as possible to reduce its kinetic energy. However, because of the high rotor speeds involved, this has proved less than satisfactory; i.e., even a very light rotor has sufficient energy at high speed to produce an unacceptable amount of overtightening if this energy is transmitted to the fastener.

It is a primary object of the present invention to provide novel fastener tools which are improvements over those described above and, more specifically, to provide power-operated fastener tools which are much less sensitive to joint hardness than heretofore available tools and which are accordingly capable of accurately controlling the torque to which fasteners are tightened without adjustment irrespective of the hardness of the joints involved.

The foregoing and other objects of the invention are achieved by interposing a brake or energy absorbing device including a torsion member in the drive train between the motor and output member of the fastening tool. As the tool rotates the fastener and the latter starts to develop a rotation resisting force, the torsion member of the kinetic energy absorbing device (which may take the form of a fully relaxed spiral or clock-type spring) begins to exert a rotation resisting force on and thereby reduce the speed of the tool motor.

It is preferred that the energy absorbing device be located near the output member of the drive train so that it will absorb the kinetic energy of any gears or other rotating components in the drive train. This is not essential, however, as the rotor of the fastener tool motor is the main source of the kinetic energy which causes overtightening.

As the fastener is rotated by a tool in accord with the principles of the present invention, the restraining force exerted by the device increases, continuously reducing the speed of the motor. By the time the fastener is tightened to the selected torque, the motor is stalled or at least rotating at a speed well below its initial operating speed. Consequently, when this torque is reached, the rotating motor components (principally the rotor) and the rotating drive train components do not have sufficient kinetic energy to appreciably overtighten the fastener. This is because the kinetic energy of the rotating motor and drive train components is proportional to the square of the speed at which they are rotating. Therefore, even if this speed is only reduced by one-half in the manner discussed above, the kinetic energy of the rotating components can be reduced to one-fourth of what it would otherwise be.

As suggested in the preceding paragraph, the energy absorbing device may be designed so that it will have a sufficiently large capacity to simply stall the motor of the tool as the fastener is tightened to the desired torque. Alternatively, an acutating mechanism can be incorporated in the energy absorbing device to shut off the tool motor or disengage a clutch when the desired torque is reached. In this case the kinetic energy of the rotating motor components will be sufficiently low to keep the fastener from being significantly overtightened because of their reduced speed of rotation, especially if the torque to which the fastener is to be tightened is close to the stall torque of the motor. That is, the closer the torque to which the fastener is tightened is to the stall torque of the motor, the slower the motor will be rotating when it is shut off.

In short, in the novel tools of the present invention, the torsion type energy absorbing component is fully relaxed at the start of the fastener tightening operation and begins to wind or flex and absorb kinetic energy from the rotating drive components as soon as rotation resisting torque is developed by the fastener being tightened. This flexing or winding continues as the fastener is tightened to the selected torque, and the maximum deflection of the component occurs essentially as the fastener reaches the selected torque. In contrast, the spring of a conventional torque responsive control is partly or pre-wound at the start of the fastening operation. It does not wind further as the tightening operation proceeds, but acts as a rigid link until the fastener is tightened to or reaches a selected torque. At this point, it begins to wind further (typically 18°–23°) to operate a shut-off or clutch disengaging mechanism.

That the novel energy absorbing devices of the present invention can be used with both stall and shut-off type tools further distinguishes them from prior art torque control devices in which a spring is wound, axially shortening or compressing the spring. As discussed above, in these prior art devices, the spring acts as a solid link until the fastener is tightened to the torque at which the spring is set. The spring then begins to wind and shorten and thereby produce a differential or relative motion between the components drive-connected by it. This motion is utilized to shut off the tool motor or to disengage a clutch. This type of mechanism is never found in a stall-type tool. For the motor to reach its stall torque, the spring would have to be set to the same stall torque. And, as the motor would stall at this torque, the spring would have no function since it would merely act as a solid link throughout the fastener setting operation until the motor stalled.

If the preferred spring type of energy absorbing device is employed, it will preferably be dimensioned so that the spring (or springs) will or can be adjusted to wind through at least the better part of one revolution or more before the tool motor stalls or the motor is shut off or the clutch mechanism is disengaged. Thus, the tool never "sees" a joint which is harder than a one turn joint.

Experience has shown that sensitivity to joint hardness in many cases does not become a major problem unless joints harder than one turn joints are involved. Consequently, although a spring arrangement capable of winding more than one turn may provide optimum insensitiveness to joint hardness, a one turn spring will prove satisfactory in many circumstances. Furthermore, springs capable of winding through plural turns may prove too bulky for some applications of the invention as the number of turns which the spring is capable of making is tied to the bulk of the spring or springs.

Not all fastener tool rotors turn at the same speed, and the rotor of a given tool may in many cses be made to turn at different speeds. At lower rotor speeds, spring type energy absorbing devices which wind only one-half turn to stall the tool motor have proven satisfactory.

In another aspect the present invention resides in the provision of an attachment which includes an energy absorbing device of the type described above. This attachment is designed so that it can be attached to conventional power-operated fastener tools to provide them with the capabilities of fastener tools constructed in accord with the principles of the present invention.

Accordingly, another important and primary object of the invention resides in the provision of novel attachments for making power-operated fastening tools less sensitive to joint hardness and thereby making them capable of accurately controlling the torque to which fasteners are tightened without adjustment irrespective of the hardness of the joints involved.

Other important but more specific objects of the invention reside in the provision of energy absorbing devices for power-operated fastener tools and/or attachments therefor in accord with the preceding objects:

(1) which include energy absorbing devices capable of being so adjusted as to vary the torque to which a fastener will be tightened.

(2) which are simple and rugged and therefore have a long useful service life and are relatively inexpensive to manufacture and maintain.

(3) which are adaptable to fastener tools of widely diverse types.

(4) which are capable of slowing the speed of rotation of a fastener tool motor and/or rotating drive train components of the tool and are thereby capable of reducing the kinetic energy which can be imparted to a fastener being tightened by the tool after the fastener is tightened to a preselected torque.

(5) which, in conjunction with object No. 4, have a sufficiently large capacity to absorb substantially all of the kinetic energy of the fastener tool motor, so that the motor will stall as the torque on the fastener reaches the stall torque of the motor, thereby limiting the torque on the fastener to the stall torque of the motor.

(6) which include one or more springs which are wound from an initial relaxed condition as a fastener is tightened and thereby exert a continuously increasing rotation resisting force on the fastener tool motor, thereby continuously decreasing the speed and the kinetic energy of the motor as the fastener is tightened.

(7) which possess various combinations of the foregoing attributes.

Other important objects and features and further advantages of the invention will become apparent from the appended claims and as the ensuing detailed description and discussion proceeds in conjunction with the accompanying drawing, in which:

Figure 2:
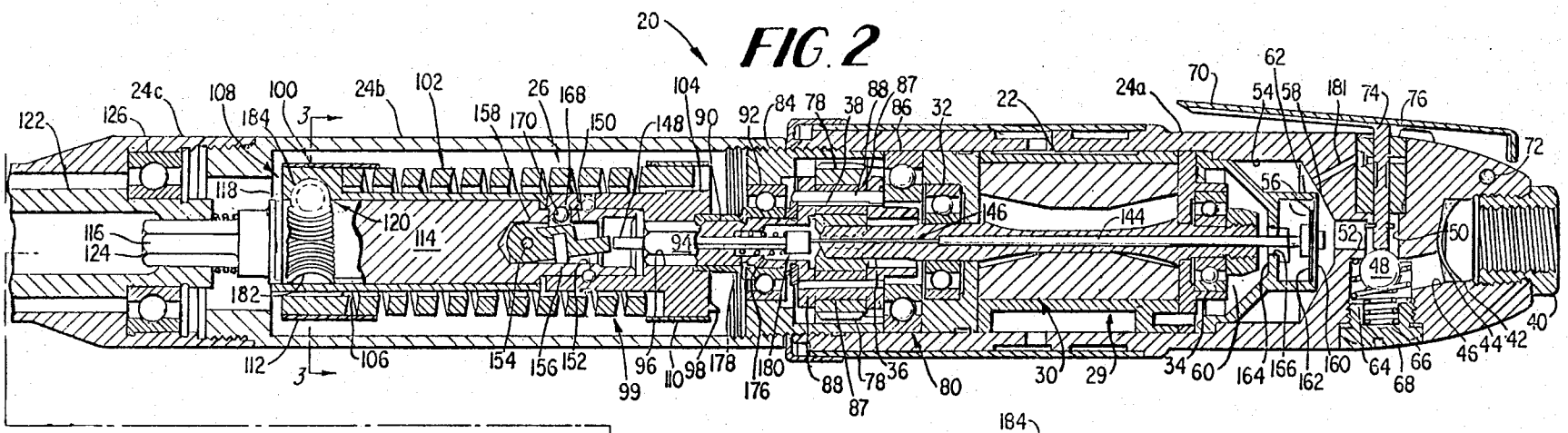
FIG. 2 is a longitudinal section through the tool.
Figure 1:
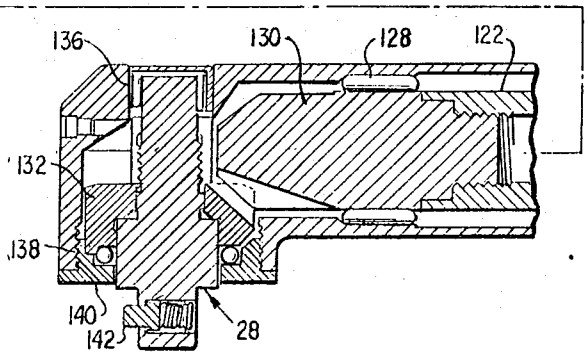
FIG. 1 is a side view of a power-operated tool constructed in accord with the principles of the present invention.
Figure 1:
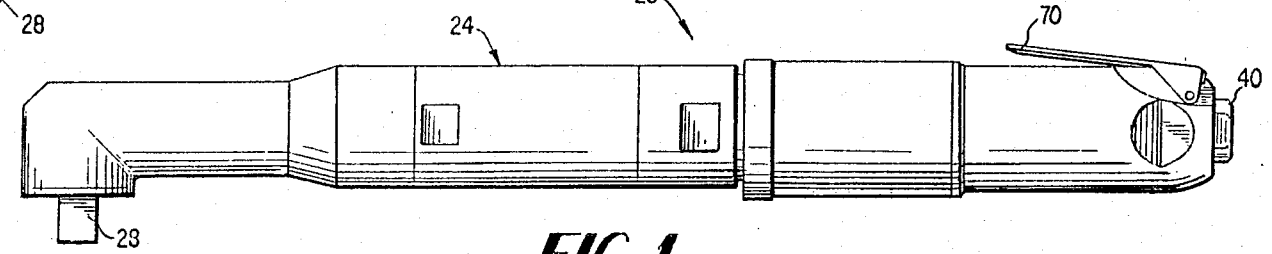

Referring now to the drawing, FIGS. 1 and 2 illustrate a power-operated fastener tool 20 of the nut runner type, which is constructed in accord with the principles of the present invention. Tool 20 includes an air motor 22 housed in a casing 24 having motor, intermediate drive train and angle head sections 24*a*, 24*b*, and 24*c* and connected through a multi-component drive train 26 to a rotatably mounted output member 28, which is adapted to have a socket or other fastener engageable component secured to it.

There are of course a variety of fasteners which can advantageously be tightened by employing tools which embody the principles of the present invention. Accordingly, the term "fastener engaging component", as employed herein, is intended to have a broad meaning and to include, without limitation, flexible and rigid extension shafts and other motion transmitting members or mechanisms to which the screwdriver or other bit, socket, or other components directly engaging the fastener might be attached.

Referring again to the drawing, air motor 22 is of a commercially available type and will not be described in detail herein. Briefly, however, the air motor includes a casing 29 in which a rotor 30 is rotatively supported by bearings 32 and 34. Rotor 30 includes a shaft 36 with a pinion 38 integrally formed on its left-hand end as shown in FIG. 2. Rotor 30 turns at high speed under no-load conditions (typically on the order of 20,000 rpm) and, accordingly, possesses considerable kinetic energy.

Air is supplied to motor 22 through a line (not shown) connected to a fitting 40 which is threaded into an aperture or passage 42 through the rear end of casing section 24*a*. Also disposed in aperture 42 is a filter 44 for removing debris from the air.

From passage 42 the air flows through a passage 46, around a valve 48, and through passages 50 and 52 into a chamber 54 also formed in casing section 24*a*. From chamber 54, the air flows around a valve member 56 and through communicating passages 58 and 60 in a fitting 62 into motor 22 to drive rotor 30.

Valve member 48 is biased against a seat at the inlet end of passage 50 and laterally positioned by springs 64 and 66, which are kept in place by a threaded retainer 68. Valve member 48 may be displaced from the illustrated seated position to allow air to flow from passage 46 into passage 50 by depressing a lever 70 pivotally fixed to tool casing 24 as by pivot pin 72. Lever 70 abuts a plunger 74 slideable in a guide or fitting 76 disposed in casing section 24*a*. Accordingly when lever 70 is depressed toward casing 24, plunger 74 unseats valve member 48. Subsequent release of lever 70 allows spring 66 to reseat valve member 48, restoring plunger 74 and lever 70 to the illustrated positions.

Referring again to FIG. 2 of the drawing, the pinion 38 on the rotor shaft 36 of air motor 22 meshes with the planet gears 78 of a conventional planetary gear assembly 80, which is the initial component of drive train 26. Planet gears 78, which also mesh with an internal gear 84 threaded into casing section 24*a* against a bearing 86, are journalled on planet rollers 87 which provide bearings between the planet gears and planet pins 88. The planet pins are supported from a planet cage 90, which is rotatably supported in casing 24 by rotor bearing 86 and by bearing 92. The left-hand end of the planet cage (as shown in FIG. 2) terminates in an integral, hexagonal drive or output member 94.

The pinion 38 on motor output shaft 36 drives planet gears 78 around internal gear 84. This rotates the output member 94 of planet cage 90 since the planet gears are connected to the latter through planet pins 88. The planetary drive 80 will typically effect a speed reduction of from 20,000 to 1300–1500 rpm; i.e., with rotor 30 of motor 22 rotating at 20,000 rpm, output shaft or member 94 of reduction drive 80 will rotate at 1300–1500 rpm.

As indicated above, the planetary gear reduction drive just described is of a conventional construction. For this reason and because the details of this drive are not part of the present invention, it will not be described further herein.

Also, it is to be understood that double planetary, reversible, and other types of drives can be substituted for planetary gear assembly 80, if desired.

Referring again to FIG. 2, the output member 94 of planetary gear drive 80 extends into a hexagonally configured recess 96 (see also FIG. 4) in the input member 98 of an energy absorbing device or sink 99 in accord with the principles of the present invention. As discussed above, it is the function of this energy absorbing device or brake to gradually slow down and absorb kinetic energy from the rotating components of motor 22 and other components of drive train 26 (primarily from rotor 30) as a fastener is tightened and thereby prevent this energy from being transmitted to and overtightening the fastener.

Referring again to FIG. 2, in addition to input member 98 brake 99 includes an output assembly 100 and a torsion type energy absorbing component in the form of a spiral type spring 102. One end of spring 102 extends into a recess or slot 104 in the input member 98 of the energy absorbing device. The opposite end of the spring extends into a similar recess or slot 106 in an outer, T-sectioned member 108 of output assembly 100, which will for the most part be referred to hereinafter as an "intermediate" member. Sleeves 110 and 112 pressed on or otherwise fixed to input and intermediate members 98 and 108 assist in maintaining spring 102 in place.

As will be apparent from the foregoing and the description of tool 20 which follows, the input member 98 of energy absorbing device 99 is freely rotatable relative to output assembly 100 when the tool is at rest except for the restraint exerted by spring 102 ("at rest" as used herein is any time that a rotation resisting force is not exerted on the output member of a tool or attachment). Accordingly, spring 102 is free to completely relax when the tool is at rest.

As best shown in FIG. 2, output assembly intermediate member 108 surrounds and is supported by an output shaft 114, which terminates in an integral, hexagonal output member 116. Intermediate member 108 is prevented from moving to the left on shaft 114 (as shown in FIG. 2) by a conventional clip-type retainer 118. During operation of tool 20, output assembly members 108 and 114 rotate as a unit due to the connection between the two afforded by an adjusting mechanism 120, which will be described in detail later.

One end of energy absorbing device 99 is rotatably supported in casing section 24b by the output member 94 of planetary gear drive 80. The other end is similarly supported by a drive shaft 122 having a hexagonal recess 124 into which the output member 116 of the shock absorbing device extends. This also drive connects shaft 122 to the output assembly 100 of the energy absorbing device.

Driven shaft 122 is rotatably supported in casing section 24c by a bearing 126 at the right-hand end of the shaft and by a bearing 128 which surrounds a bevel pinion 130 threaded into its left-hand end.

Pinion 130 meshes with a bevel gear 132 mounted on the tranversely extending a gearshaft or output member 28 mentioned above. This shaft is rotatably supported in member 24c by bearings 136 and 138 and is secured in place by a locking member 140 threaded into casing section 24c. A spring loaded detent 142 is provided at the lower end of shaft 28 to secure sockets or other fastener engaging components (not shown) to shaft 28 for rotation therewith.

As in the case of other components of tool 20 discussed above, those identified by reference characters 122 et seq. are of a commercially available construction. Accordingly, it is not believed necessary to describe them further herein.

To review the operation of tool 20 as thus far described, the fastener tightening operation is initiated by depressing lever 70 to admit air to the motor 22, rotating its rotor 30. The speed of rotation is reduced in planetary gear assembly 80, which rotates the input member 98 of energy absorbing device 99. Input member 98 rotates output member 116 through spring 102 and intermediate member 108, and the output member accordingly rotates the shaft 122 to which it is drive-connected. This shaft rotates output shaft 28, causing the latter to rotate the faster engaging component (not shown) secured to it by detent 142 to tighten the fastener.

As the fastener begins to tighten, it exerts a torque on shaft 28 which resists or opposes the torque generated by motor 22. This resisting torque is transmitted back through the drive train 26 just described, and spring 102 begins to "wind up" from its initial, fully relaxed condition. As it does so, it immediately begins to absorb kinetic energy from rotor 30 and the other rotating components of the motor and drive train 26 and reduces the speed of rotation of these components. As the fastener continues to tighten, spring 102 continues to wind and further decreases the speed of motor 22 and the other rotating components and reduce their kinetic energy until the motor is rotating at an extremely low speed and the rotating components have only an insignificant amount of kinetic energy. The motor then "lugs" until the fastener is tightened to the stall torque of the motor, at which point the motor stalls.

Since essentially all of the kinetic energy of the rotating components is absorbed in spring 102, the torque which the motor is capable of exerting on the fastener being tightened does not exceed the stall torque of the motor. Conversely, the fastener cannot be tightened to a torque exceeding the stall torque of the motor.

For energy absorbing device 99 to operate in the manner just described, the energy absorbing capacity of device 99 must of course at least equal the no-load kinetic energy of the rotating motor and drive train components. Also, as discussed above, the energy absorbing components of the device are preferably designed to increase the softness of the joint as "seen" by the fastener tool by one-half to one or more turns.

As is apparent from the foregoing, the fastener will be tightened to substantially the stall torque of the motor irrespective of the hardness of the joint involved. Consequently, fasteners of the same type can be tightened to substantially the same torque even if joints of widely varying hardness are involved. This is important since the fasteners in the harder joints will not be overtightened to a harmful extent and those associated with the softer joints will not be undertightened.

To particularize the foregoing discussion, a typical application of the present invention would involve the use of 5/16-24 fasteners to hold one-quarter inch thick steel plates together. In one extreme case (a hard joint), the two plates might be ground flat. In this case, the fastener would typically be run onto the bolt or stud until handtight and a power-operated fastener tool having a stall torque of 144 pound inches applied to the fastener. Typically, the fastener would only rotate 40° or 50° until it was torqued to 144 pound inches; and the energy used in tightening the fastener would be about 4.7 foot pounds.

In the opposite extreme case, that of a soft joint, the same bolt and similar plates would be involved, but the plates would be bent or warped and would be ⅛ inch apart after the fastener was tightened handtight. In this case, it might require three full revolutions of the fastener to pull the plates together and tighten it to the same 144 pound inches torque. The energy required to tighten the fastener would be 113 foot pounds; that is, 24 times as much as was required to tighten the same fastener in the hard joint.

The rotating motor and drive train components of the tool employed would have perhaps 15 foot pounds of kinetic energy. Only about one-third of this energy would be dissipated in tightening the fastener in the hard joint. The remaining ten plus foot pounds of energy would accordingly simply be transmitted to the fastener and overtighten it by a conventional tool.

In the case of the soft joint, the 113 foot pound energy demand would greatly exceed the 15 foot pounds of kinetic energy in the rotating components. Accordingly, as the fastener tightened, the tool would simply slow down and finally stall as discussed above.

The operation of a tool in accord with the principles of the present invention would still be substantially the same when a soft joint is involved. However, spring 102 would typically be dimensioned so that the torque in it would build up from 0–100 pound inches in approximately one full turn, making the spring capable of absorbing 26 foot pounds of energy. Since this exceeds the kinetic energy of the rotating components, the tool slows down and stalls when a hard joint is involved as in the case of the soft joint; and the fastener is tightened only to the stall torque of the motor.

To illustrate the increase in insensitiveness to joint hardness provided by the present invention, the following test was made: a stall type tool of the type described herein supplied with air at a pressure of 85 psi was used to tighten fasteners in four joints ranging from very hard (324 foot-pounds per revolution) to very soft (10.2 foot-pounds per revolution) (in other words, one joint was approximately thirty times as hard as the other). Each joint was tightened 25 times, and the average torque to which each joint was tightened was calculated. The results were as follows:

TABLE 1

| Joint Hardness (ft-lb) | Torque on Fastener (average of 25 runs) (ft-lb) |
|---|---|
| 324 | 32.076 |
| 92.4 | 31.912 |
| 25.0 | 32.096 |
| 10.3 | 31.580 |

As is apparent from the foregoing, the torque to which the four fasteners were tightened varied by a maximum of only 0.5 foot-pounds even though the joints ranged from very soft to very hard.

In contrast, a fastener tool with a torque responsive motor shut-off control of improved design as disclosed in U.S. Pat. No. 3,195,704 issued July 20, 1965, to E. Linsker for TORQUE RESPONSIVE CONTROL FOR MOTOR DRIVEN TOOL operated at the same pressure to tighten the same fasteners in the same joints produced the following results:

TABLE 2

| Joint Hardness (ft-lb) | Torque on Fastener (average of 25 runs) (ft-lb) |
|---|---|
| 324 | 31.4 |
| 92.4 | 31.1 |
| 25.0 | 30.1 |
| 10.2 | 29.3 |

As can be seen from the foregoing, the variation in the torque to which the fasteners were tightened (2.1 foot pounds) was four times as great as when the tool of the present invention was employed.

In conjunction with the foregoing a statistical analysis of the data from the tests just described showed that the tool of the present invention has a 6-sigma scatter of 2.87 foot-pounds when operated at 85 psi while the 6-sigma scatter of the conventional tool is 5.74 foot-pounds. This means that the minimum and maximum torque on 99% of all fasteners of the type employed in the above-described tests tightened by the tool of the present invention in joints ranging from 10.2 to 324 foot pounds will differ by only 2.87 foot pounds while the corresponding deviation for fasteners tightened by the conventional tool will be 5.74 foot pounds. In other words the variation in tightness of 99% of such fasteners tightened by a tool in accord with the present invention will be only one-half the variation of 99% of those tightened by a torque responsive fastener tool, even one of the advanced design.

In a second set of tests the same tools were employed, but the pressure on the air supplied to the tools was reduced to 60 psi. The following results were obtained.

TABLE 3

| Joint Hardness (ft-lb) | Torque on Fastener (average of 25 runs) (ft-lb) | |
|---|---|---|
| Tool of the Present Invention | | |
| 324 | 25.20 | |
| 92.4 | 24.80 | |
| 25.0 | 24.65 | |
| 10.3 | 24.66 | |
| Maximum deviation of average torques | | 0.54 ft-lb |
| 6-sigma scatter | | 2.44 ft-lb |
| Conventional Tool | | |
| 324 | 23.68 | |
| 92.4 | 21.11 | |

TABLE 3-continued

| Joint Hardness (ft-lb) | Torque on Fastener (average of 25 runs) (ft-lb) | |
|---|---|---|
| 25.0 | 20.22 | |
| 10.2 | 20.06 | |
| Maximum deviation of average torques | | 3.62 ft-lb |
| 6-sigma scatter | | 8.89 ft-lb |

The series of tests even more strikingly illustrates the superiority of the tools described herein over those equipped with conventional torque responsive controls as far as their capability for tightening fasteners to a uniform torque irrespective of joint hardness is concerned.

The data tabulated in Table 3 also makes it apparent that the torque to which a stall-type tool in accord with the present invention will tighten a fastener can be altered simply by changing the pressure on the air supplied to the tool.

In each of the tests described above the two fastener tools compared were identical except that the "tool of the present invention" was equipped with an energy absorbing device as described above while the "conventional tool" was equipped with a torque responsive motor shut-off device of the type described in U.S. Pat. No. 3,195,704.

In addition to operating in the stall mode discussed above, tool 20 can be adjusted so that the supply of air to motor 22 will be shut off when the fastener being tightened reaches a selected torque. More specifically, with reference to FIGS. 2–4, the disc valve member 56 around which the air flows through passage 58 to motor 22 is supported in the passage by the first of a series of connected valve stems 144, 146, and 148.

These shafts extend through rotor 30 and planet cage 90 with the left-hand end of shaft 148 (as shown in FIG. 2) abutting the free end of a pawl 150. This pawl is pivotally supported in a blind bore 152 in the output shaft 114 of energy absorbing device 99 by a transversely extending pivot pin 154. Pawl 150 is biased to the valve stem engaging position shown in FIG. 2 by a spring-loaded pin 156 seated in a recess 158 in the pawl.

To shut off the supply of air to motor 22, pawl 150 is pivoted in a clockwise direction as shown in FIG. 2 out of engagement with the left-hand end of valve stem 148. As shown in the same figure, the annular passage between fitting 62 and valve member 56 is relatively narrow, and the flat surface 160 of the valve member is relatively large in comparison. Accordingly, the valve member operates as a differential piston. That is, there is a relatively large pressure drop across the valve member because of the restricted passage through which the air must flow. Accordingly, when the restraint offered by pawl 150 is removed from the left-hand end of valve stem member 148, the differential pressure across valve member 56 produces a force which moves the valve member to the left as shown in FIG. 2 until the smaller, left-hand face 162 of the valve member seats on a transversely extending wall 164 in fitting 62. This keeps air from flowing through the aperture 166 in partition 164 to motor 22.

Figure 4:
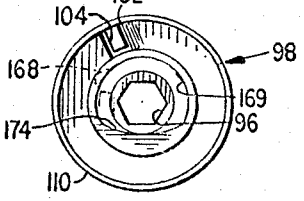
FIG. 4 is an end view of a kinetic energy absorbing mechanism component which is employed in the tool.

The mechanism for moving pawl 150 out of engagement with valve stem member 148 includes a cam follower 168 and a cam 169. The cam follower is disposed in a recess 170 in energy absorbing device output shaft 114. Recess 170 communicates with the bore 152 in which pawl 150 is mounted so that cam follower 168 abuts or engages pawl 150. Cam 169 is formed in the left-hand end portion of energy absorbing device input member 98. The physical relation between the cam and cam follower is shown in FIG. 4 in which the follower is illustrated in dotted lines.

As a fastener is tightened by tool 20 and spring 102 winds, the input member 98 of the energy absorbing device rotates relative to output shaft 114 of the device, and cam 169 accordingly rotates relative to follower 168. As the high point 174 of the cam reaches the follower, it forces the follower downwardly as shown in FIG. 2. The follower accordingly pivots pawl 150 in a clockwise direction out of engagement with valve stem member 148 to free valve member 58 for movement to its "closed" position in the manner described above.

Following the tightening of a fastener in the manner just described, the operator of the tool releases lever 70 and removes the tool from the fastener. At this point a compression spring 176 surrounding valve stem member 148 and disposed between a shoulder 178 on planetary cage 90 and a boss 180 on the valve stem member moves the valve stem and valve member 56 to the right to the open position shown in FIG. 2. The air trapped between valves 48 and 56, which would resist this movement, is bled off through a passage arrangement in the rear or operator end of the tool identified generally by reference character 181.

Also, as tool 20 is removed from the fastener, spring 102 unwinds to its initial, fully relaxed condition since output assembly 100 is freely rotatable relative to input member 98 (rotor 30 runs in reverse as this occurs). The high point 174 of cam 169 accordingly rotates off follower 168, allowing pawl 150 to return to the position shown in FIG. 2 to complete the operating cycle.

Figure 3:
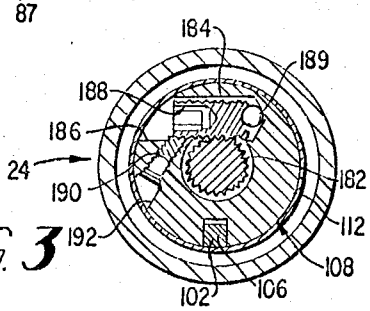
FIG. 3 is a section through the tool taken substantially along line 3—3 of FIG. 1.

The adjusting mechanism 120 referred to briefly above is provided so that the torque at which motor 22 will be shut off in the manner just described can be varied. Referring now to FIGS. 2 and 3, threads 182 are formed around the periphery of energy absorbing device output shaft 114 adjacent the left-hand end of intermediate member 108. These threads are engaged by a screw 184 threaded into a bore 186 formed in and extending to the exterior of intermediate member 108. A socket 188 is formed in the head of screw 184 so it can be rotated as by an Allen wrench or the like.

With tool 20 at rest, output shaft 114 can be rotated relative to intermediate member 108 by turning screw 184 (this rotation is facilitated by a ball 189 between the inner end of screw 184 and bore 186). As shaft 114 rotates, it carries cam follower 168 around cam 169 to a different position. The position of the follower relative to the cam with the tool at rest determines the torque at which the supply of air to motor 22 will be shut off.

More specifically, if the follower is positioned so that it is near the high point 174 of cam 169, the high point will engage the follower during the fastener tightening operation after there has been only a relatively small amount of rotation of input member 98 relative to output assembly 100 to depress pawl 150 and shut off the air supply. This requires that spring 102 only be wound to a small extent. Accordingly, shut off will occur after the fastener has been tightened to only a relative low torque.

As follower 168 is moved further away from the high point 174 of the cam in the manner described above, the distance to which the cam must rotate to depress pawl 150 during the fastener tightening operation is correspondingly increased. This requires a progressively increased windup of spring 102; and, consequently, the torque to which the fastener is tightened before shut-off occurs increases.

A component for retaining shaft 114 in the position to which it is adjusted and for locking the intermediate member to the shaft so that they will rotate as a unit during the fastener tightening operation is also included in adjusting mechamism 120. This is a screw 190 threaded into a passage 192 formed in intermediate member 108 and available from the exterior of the member. As shown in FIG. 3, screw 190 can be tightened against screw 184 to maintain the desired adjustment between intermediate member 108 and output shaft 114.

As indicated above, the principles of the present invention may also be embodied in an attachment capable of converting a conventional power-operated fastener tool to one capable of operating in accord with and having the advantages of power-operated fastener tools constructed in accord with the principles of the present invention. One form which such an attachment can take is illustrated in FIGS. 5 and 6 and identified by reference character 194.

Referring now to the figures just mentioned, the braking or energy absorbing device 194 includes an input assembly 196. The input assembly surrounds and is journalled at one end on an output shaft 198 and is retained in place on the latter by a snap-type retainer 200.

In assembly 196 includes a cylindrical casing or shell 202 and end members 204 and 206 fixed in any convenient manner in the opposite ends of casing 202. A hexagonal or other non-circular bore 208 through end member 204 is configured to match the output member (not shown) of a conventional power-operated fastener tool and thereby drive connect input assembly 196 of attachment 194 to the fastener tool output member.

Figure 5:
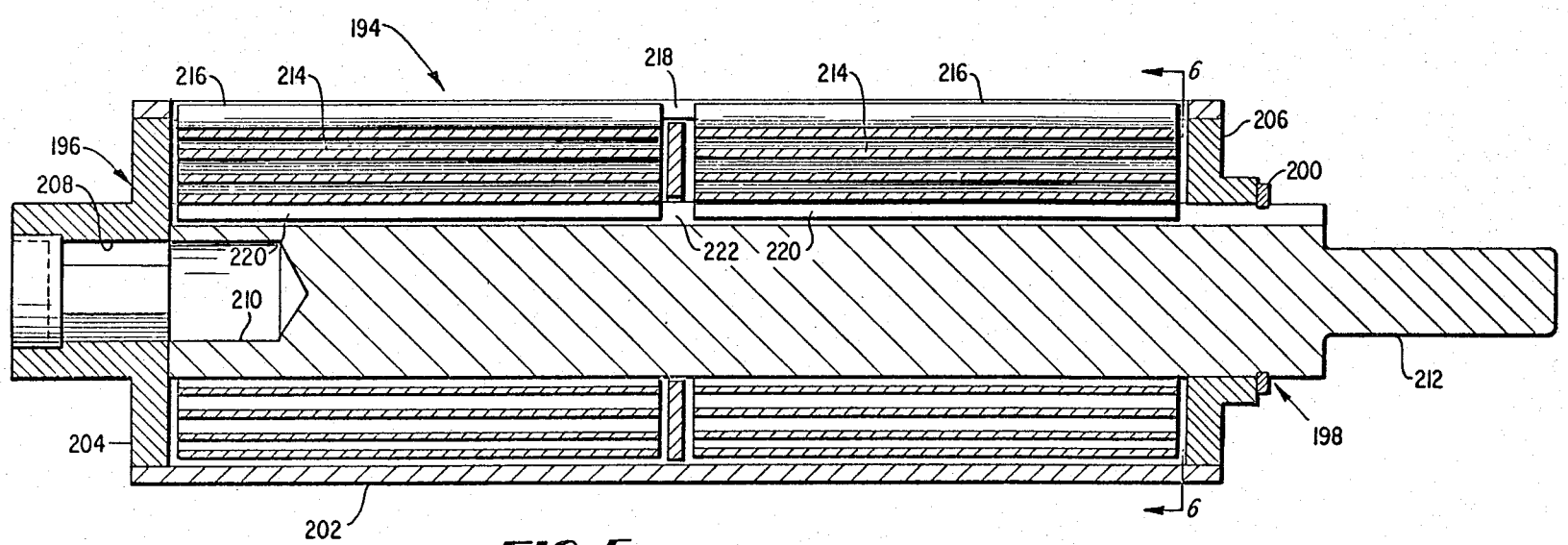
FIG. 5 is a section through an attachment which may be employed to convert a conventional power tool to one capable of operating in accord with the principles of the present invention.
Figure 6:
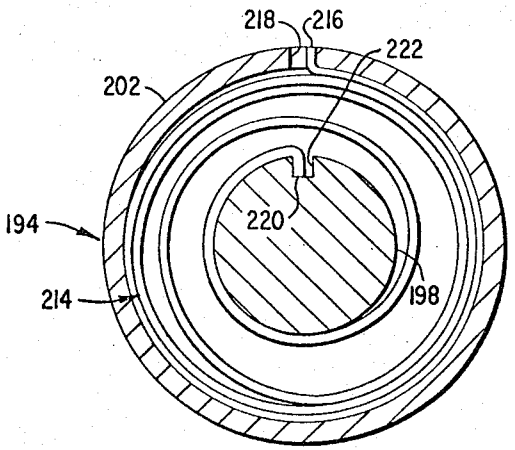
FIG. 6 is a section through the attachment of FIG. 5, taken substantially along line 6—6 of the latter figure.

A circular bore 210 is formed in the left-hand end of attachment output member 198 as shown in FIG. 5 in alignment with bore 208. The output member of the tool to which the attachment is fixed extends through bore 208 into bore 210 to keep the left-hand end of the output member aligned with end piece 204 of input assembly 196.

A square, hexagonal, or other non-circular shank 212 is formed on the right-hand end of output member 198. This shank is adapted to receive a socket or other fastener engaging or other rotary motion transmitting component.

The relatively rotatable input assembly 196 and output shaft 198 are drive-connected to two torsion type kinetic energy absorbing devices 214 which, in this embodiment of the invention, are springs of the clock type. The other ends 216 of these springs are fitted in recesses 218 in the shell 202 of input assembly 196. The inner ends 220 are fitted in recesses 222 in output shaft 198 of the attachment.

It is of course not necessary that an attachment embodying the principles of the present invention have the particular construction just described. The number of springs can be increased or decreased, as desired; and sprial springs or other torsion devices can be substituted for the illustrated clock type springs.

A tool equipped with an attachment of the character described above operates in essentially the same fashion as tool 20. The socket or other component fitted on shank 212 is engaged with the fastener to be tightened; and the motor of the tool to which the attachment is fixed is energized to rotate input assembly 196 and thereby drive output member 198 through springs 214. As the fastener begins to tighten, a rotation resisting force or torque is transmitted through output shaft 198 to springs 214, which begin to wind up from their fully relaxed at rest condition. Accordingly, springs 214 absorb kinetic energy from the motor and rotating drive train components of the tool to which the attachment is fixed in the manner discussed above in conjunction with tool 20. If the tool is of the stall type, the springs will continue to wind until the fastener is tightened to the stall torque of the motor, at which point the motor will stall and prevent the fastener from being tightened to a torque higher then the stall torque of the motor.

On the other hand, if the motor is equipped with a torque responsive shut-off or clutch mechanism, springs 214 will wind until enough energy has been stored in them to produce a rotation resisting force of sufficient magnitude to operate the torque responsive control. Again, as explained above, this will reduce the speed of the tool motor to the point that the kinetic energy in it when the torque responsive control is operated is not enough to cause overtightening of the fastener even if it is transmitted to the fastener.

Figure 7:
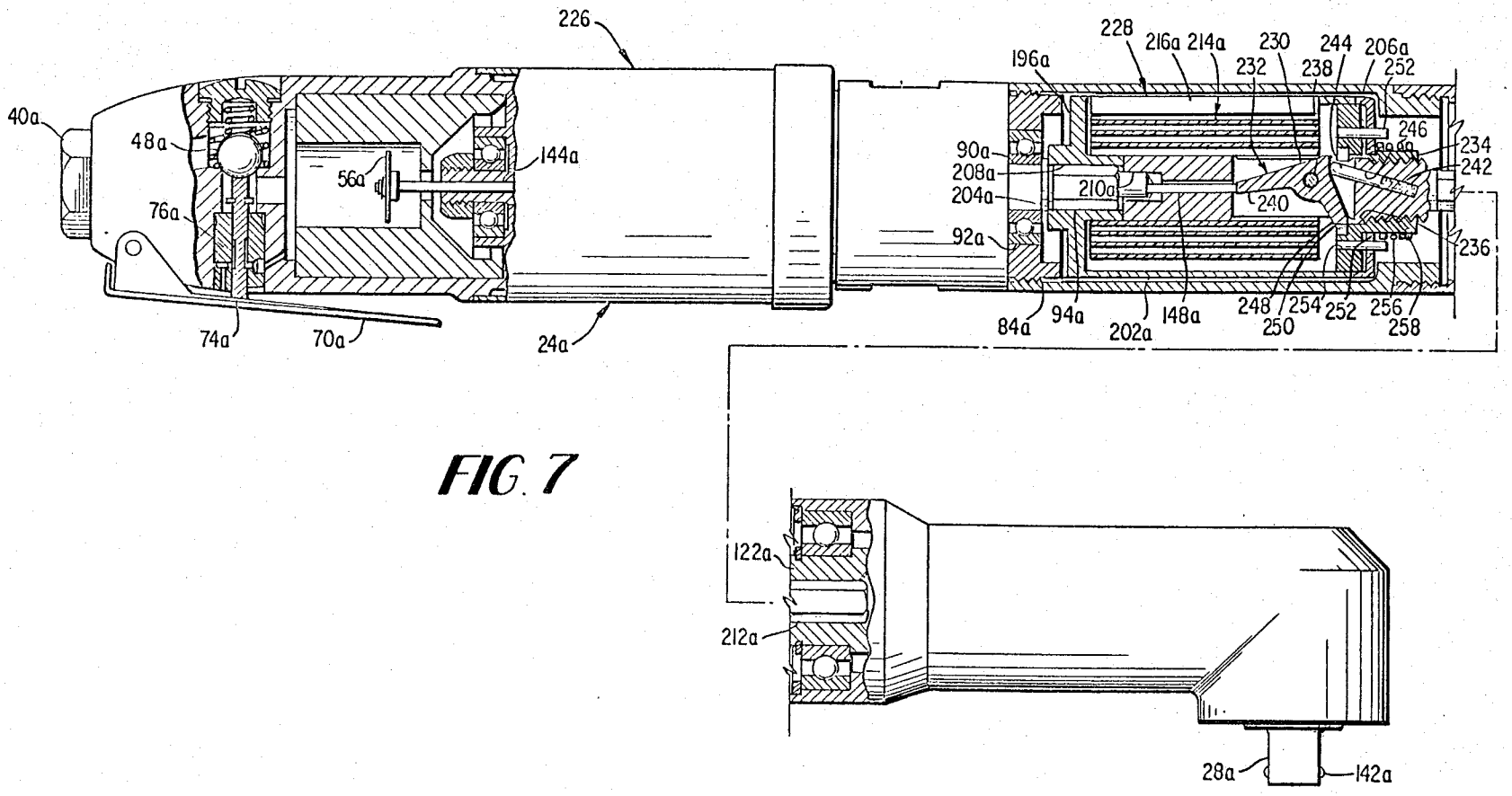
FIG. 7 is a side view, partly in section, of a second form of power-operated fastener tool constructed in accord with the principles of the present invention.

Energy absorbing devices or brakes of the type shown in FIGS. 5 and 6 may also be incorporated directly in power-operated fastener tools, and they may be easily modified to add a torque responsive shut-off capacity. A tool with both of these modifications is illustrated in FIG. 7 and identified by reference character 226. For the most part, the components of tool 226 are identical to those of tool 20 and attachment 194. Accordingly, in FIG. 7, these components have been identified by the reference characters used previously but followed by the letter "a".

The energy absorbing unit 228 employed in tool 226 differs from attachment 194 primarily in that only one energy absorbing torsion member or spring **214*a* is employed and in that it includes a torque responsive shut-off mechanism 230. Also, in this application of the invention, the input assembly 196*a* of energy absorbing device 228 is drive-connected to the output member 94*a* of planetary cage 90*a* rather than to the output member of a separate tool. Finally, the output shaft or shank 212*a* of the energy absorbing device is drive-connected to a drive shaft 122*a* incorporated in tool 226** rather then to a fastener-engaging component.

Referring again to FIG. 7, torque responsive shut-off mechanism 230 includes a bifurcated actuator 232 and a cooperating operator member 234. Actuator 232 is pivotally mounted in a bore 236 formed in output shaft **212*a* of the energy absorbing device by a transversely extending pivot pin 238. One leg 240 of actuator 232 is normally maintained in engagement with the valve stem member 148*a* of a shut-off valve arrangement of the type described above by a spring 242 and pin 244 disposed in a bore 246 also formed in the output shaft 212*a* of the energy absorbing device. These components also bias the second, depending leg 248 of the actuator against the side of a recess 250 in operator member 234**.

Operator 234 is threaded on output shaft **212*a* of the energy absorbing device and drive-connected to the input assembly 196*a* of the latter by pins 252. These are fixed to the operator and extend through apertures 254 in the end piece 206*a* of the input assembly. Operator 234 accordingly rotates with but is free to move longitudinally relative to input assembly 196*a*. A compression spring 256 surrounding operator 234 and disposed between a snap-in retainer 258 on the latter and the end piece 206*a* of the input assembly insures that the input assembly and operator maintain the proper spatial relationship during operation of tool 226**.

Tool 226 operates in essentially the same manner as tool 20 as far as the energy absorbing operation of brake 228 is concerned. Accordingly, the discussion of the energy absorbing device employed in tool 20 in equally applicable to energy absorbing device 228; and it will therefore not be repeated here.

As the spring **214*a* in tool 226 winds, input assembly 196*a* of the energy absorbing device rotates relative to output shaft 212*a* as in the embodiments of the invention described above. As this occurs, operator 234 rotates relative to and accordingly moves to the left along output shaft 212*a* due to the threaded connection between these two components. As this occurs, the operator pushes the lower leg 248 of acutator 232 to the left until, as the fastener reaches the preselected torque, leg 240 of the actuator rides off of the end of valve stem member 148*a*. This frees the valve 56*a* attached to valve stem member 144*a* for movement to the "shut-off" position in the manner discussed above in conjunction with tool 20. Subsequent removal of the tool from the fastener permits spring 214*a*** to unwind and reset the components of the actuating mechanism to their initial, illustrated positions.

It will be apparent to those familiar with the arts to which the present invention relates that the principles of the present invention are applicable to power-operated fastener tools other than those illustrated in the drawing and expressly discussed above. These include, without limitation, screwdrivers, nut runners of other configurations than those illustrated, etc. To the extent that these and other applications of the invention are not expressly excluded from the appended claims, they are fully intended to be covered therein.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A power-operated tool for tightening fasteners comprising an air motor; an output member adapted to rotate a fastener engaging component; a speed reducing drive train means drive-connecting the motor of said tool to the output member therof, said motor and said drive train means including rotatable components; and means drive-connected between said drive train means and said output member providing an energy sink capable of absorbing substantially all of the kinetic energy generated by said rotatable motor and drive train means components whereby, as said fastener is tightened, the kinetic energy of said components is absorbed by said energy sink providing means and the speed of said motor is decreased to a speed below its no-load speed.

2. The tool of claim 1, wherein said output member is freely rotatable relative to said motor except for the means providing the energy sink whereby, when said fastener engaging component is removed from the fastener being tightened, the energy stored in said energy sink providing means will be released and run said motor in the reverse direction to thereby dissipate from said sink providing means substantially all of the energy stored therein.

3. A power-operated tool for tightening fasteners comprising a motor; an output member; and a drive train means drive-connecting the motor to the output member, at least one of said motor and said drive train means having at least one rotatable drive component and said drive train means including at least two means connected in parallel operable beginning within the exertion of a rotation resisting force by the fastener being tightened to brake and thereby reduce the speed and absorb the kinetic energy of said rotating drive component(s) and thereby keep said energy from being applied to and over-tightening a fastener engaged by said output member.

4. A power-operated tool for tightening fasteners comprising a motor; an output member; a drive train means drive-connecting the motor to the output member, at least one of said motor and said drive train means having at least one rotatable drive component and said drive train means including means operable beginning with the exertion of a rotation resisting force by the fastener being tightened to brake and thereby reduce the speed and absorb the kinetic energy of said rotating drive component(s) and thereby keep said energy from being applied to and overtightening a fastener engaged by said output member; means for automatically shutting off said motor when a rotation resisting torque of a predetermined magnitude is exerted on said output member; and means for adjusting the torque at which said motor will be automatically shut off by said just-mentioned means.

5. A power-operated tool for tightening fasteners comprising a motor; an output member; and a drive train means drive-connecting the motor to the output member, at least one of said motor and said drive train means having at least one rotatable drive component and said drive train means including means operable beginning with the exertion of a rotation resisting force by the fastener being tightened to brake and thereby reduce the speed and absorb the kinetic energy of said rotating drive component(s) and thereby keep said energy from being applied to and overtightening a fastener engaged by said output member, said brake means comprising an elastically deformed member having one end rotatable with said drive component(s) and the other end rotatable with the output member, the energy absorbing capacity of said member exceeding the kinetic energy in the rotating drive component(s) at the no-load speed of the tool, whereby the maximum torque that can be exerted on said output member does not substantially exceed the stall torque of the motor.

6. In a power-operated tool for tightening fasteners and the like; a rotatably mounted driving member; a rotatably mounted driven member; means for rotating said driving member; means adapted to engage a fastener, said last-mentioned means being rotatable by said driven member; and a torsion means for transmitting rotary movement of said driving member to said driven member, said torsion means having one end thereof rotatable with said driven member and the other end thereof rotatable with the driving member, said driven member being freely rotatable in both directions relative to said driving member and said torsion means being the sole means constraining relative rotation between said driving member and said driven member, whereby said torsion means is operable beginning with the exertion of a rotation resisting force by the fastener being tightened to absorb kinetic energy from the rotating components of said tool and thereby prevent said kinetic energy from being transmitted to and over-tightening said fastener, said torsion means being incorporated in a kinetic energy absorbing means and the energy absorbing capacity of said kinetic energy absorbing means at least equalling the kinetic energy of the motor at no-load speed whereby, as the fastener is tightened, said last-mentioned means will slow said motor down until the motor stalls so that, as the fastener is tightened to the selected torque, the torque which the motor is capable of transmitting is limited to the stall torque of the motor and said motor is thereby prevented from tightening the fastener to a torque exceeding the stall torque of the motor.

7. A power tool for setting fasteners to a specified torque comprising a motor having a rotary drive and adapted to be energized to rotate the rotary drive at a specified free-running no-load speed and with a drive torque which increases as the rotary drive speed decreases from said no-load speed, a rotary output for setting fasteners, and unloaded torsion spring means interconnecting the rotary drive and rotary output for driving the rotary output and for absorbing at least substantially all of the kinetic energy generated by said rotary drive as a fastener is set, the torsion spring means having a resistance to torsional deflection which increases with deflection and being operable to be angularly deflected continually and unrestrictively from its unloaded condition to provide for smooth deceleration of the rotary drive by the rotary output from its free-running no-load speed with the motor remaining energized.

8. The power tool of claim 7, wherein the spring means is a helical torsion coil spring having opposite ends drivingly connected to the rotary drive and the rotary output and its coils positioned therebetween with freedom of movement for unrestricted axial deflection and radial contraction responsive to loading.

9. The power tool of claim 7, wherein the motor is a rotary fluid motor set to stall or shut off at said specified torque, and wherein the spring means has a spring rate sufficient to decelerate the fluid motor to stall or shut off upon instantaneous arrest of the rotary output from free-running no-load speed.

10. In a power-operated tool for tightening fasteners and the like; a rotatable mounted driving member; a rotatably mounted driven member; means for rotating said driving member; means adapted to engage a fastener, said last-mentioned means being rotatable by said driven member; and a clock type spring means for transmitting rotary movement of said driving member to said driven member, said spring means having one end thereof rotatable with said driven member and the other end thereof rotatable with the driving member, said driven member being freely rotatable in both directions relative to said driving member and said spring means being the sole means constraining relative rotation between said driving member and said driven member, whereby said spring means is operable beginning with the exertion of a rotation resisting force by the fastener being tightened to absorb at least substantially all of the kinetic energy generated by the rotating components of said tool and thereby prevent said kinetic energy from being transmitted to and overtightening said fastener.

11. In a power-operated tool for tightening fasteners and the like: a rotatably mounted driving member; a rotatably mounted driven member; means for rotating said driving member; means adapted to engage a fastener, said last-mentioned means being rotatable by said driven member; and means operable beginning with the exertion of a rotation resisting force by the fastener being tightened to absorb at least substantially all of the kinetic energy from the rotating components of the tool generated by said components and thereby prevent said kinetic energy from being transmitted to and thereby overtightening the said fastener, said kinetic energy absorbing means comprising a spring means windable through at least about one-half of a revolution as the fastener is tightened to the selected torque, one end of said spring means being rotatable with said driven member and the other end being rotatable with the driving member, said driven member being freely rotatable in both directions relative to said driving member and said spring means being the sole means constraining relative rotation between said driving member and driven member.

12. In a power-operated tool for tightening fasteners and the like; a rotatably mounted driving member; a rotatably mounted driven member; means for rotating said driving member; means adapted to engage a fastener, said last-mentioned means being rotatable by said driven member; and a torsion means for transmitting rotary movement of said driving member to said driven member, said torsion means having one end thereof rotatable with said driven member and the other end thereof rotatable with said driving member, said driven member being freely rotatable in both directions relative to said driving member and said torsion means being the sole means constraining relative rotation between said driving member and said driven member, whereby said torsion means is operable beginning with the exertion of a rotation resisting force by the fastener being tightened to absorb at least substantially all of the kinetic energy from the rotating components of said tool and thereby prevent said kinetic energy from being transmitted to and overtightening said fastener, said driving member being the output member of a drive train having an input member rotatable by said motor, said torsion member being incorporated in a kinetic energy absorbing means also including an input member and an output member, one end of said torsion member being rotatable with the input member of the energy absorbing means, the other end of said torsion member being rotatable with the output member of said means, said input member being rotatable with the output member of the drive train, the output member of the energy absorbing means being rotatable with the driven member, and said torsion means being a spring means windable from a substantially fully relaxed condition to a wound condition by rotation of the drive train components relative to said driven member as a fastener is tightened by the tool whereby, as said spring is wound, it exerts an increasing force on said components to reduce the speed of rotation of and thereby convert the kinetic energy of the components to potential energy and store said potential energy.

13. A power-operated tool for tightening fasteners comprising a motor; an output member; and a drive train means drive-connecting the motor to the output member, at least one of said motor and said drive train means having at least one rotatable drive component and said drive train means including means operable in one single cycle during the process of tightening each separate fastener to brake and thereby reduce the speed and absorb the kinetic energy of said rotating drive component(s) and thereby keep said energy from being applied to and over-tightening the fastener engaged by said output member.

14. A power-operated tool for tightening fasteners comprising a motor; an output member adapted to rotate a fastener engaging component; a speed reducing drive train means drive-connecting the motor of said tool to the output member thereof, said motor and said drive train means including rotatable components; and means drive-connected between said drive train means and said output member providing an energy sink capable of so absorbing at least a very large part of the kinetic energy generated by said rotatable motor and drive train means components that as said fastener is tightened, the kinetic energy of said components will be absorbed by said energy sink providing means and the speed of said motor decreased to a speed below its no-load speed.

15. A power tool for setting fasteners to a specified torque comprising a motor having a rotary drive and adapted to be energized to rotate the rotary drive at a specified free-running no-load speed and with a drive torque which increases as the rotary drive speed decreases from said no-load speed, a rotary output for setting fasteners, and unloaded torsion spring means interconnecting the rotary drive and rotary output for driving the rotary output and for absorbing at least a very large part of the kinetic energy generated as a fastener is set, the torsion spring means having resistance to torsional deflection which increases with deflection and being operable to be angularly deflected continually and unrestrictively from its unloaded condition to provide for smooth deceleration of the rotary drive by the rotary output from its free-running no-load speed with the motor remaining energized.

16. A stall type power tool for setting fasteners to a specified torque comprising a motor having a rotary drive and adapted to be energized to rotate the rotary drive at a specified free-running no-load speed and with a drive torque which increases as the rotary drive speed decreases from said no-load speed, a rotary output for setting fasteners, and unloaded torsion spring means interconnecting the rotary drive and rotary output for driving the rotary output, the torsion spring means having resistance to torsional deflection which increases with deflection and being operable to be angularly deflected continually and unrestrictively from its unloaded condition to provide for smooth deceleration of the rotary drive by the rotary output from its free-running no-load speed until said motor stalls with the motor remaining energized.

17. A power-operated tool for tightening fasteners comprising a motor; an output member adapted to rotate a fastener engaging component; a speed reducing drive train means drive-connecting the motor of said tool to the output member thereof, said motor and said drive train means including rotatable components; and means drive-connected between said drive train means and said output member providing an energy sink operable beginning with the exertion of a rotating resisting force by the fastener being tightened which is capable of absorbing at least a very large part of the kinetic energy generated by said rotatable motor and drive train means components whereby, as said fastener is tightened, the kinetic energy of said components is absorbed by said energy sink providing means and the speed of said motor is decreased to a speed below its no-load speed.

* * * * *